US011460153B2

(12) United States Patent
Lin et al.

(10) Patent No.: US 11,460,153 B2
(45) Date of Patent: Oct. 4, 2022

(54) LIGHTING APPARATUS

(71) Applicant: XIAMEN LEEDARSON LIGHTING CO., LTD, Fujian (CN)

(72) Inventors: Zhiguo Lin, Fujian (CN); Yongzhe Dong, Fujian (CN); Shuxing Gao, Fujian (CN); Zhenyu Tang, Fujian (CN)

(73) Assignee: XIAMEN LEEDARSON LIGHTING CO., LTD, Fujian (CN)

( * ) Notice: Subject to any disclaimer, the term of this patent is extended or adjusted under 35 U.S.C. 154(b) by 0 days.

(21) Appl. No.: 17/337,220

(22) Filed: Jun. 2, 2021

(65) Prior Publication Data

US 2021/0372573 A1 Dec. 2, 2021

(30) Foreign Application Priority Data

Jun. 2, 2020 (CN) ..... 202020985770.7

(51) Int. Cl.

| | |
|---|---|
| ***F21K 9/232*** | (2016.01) |
| ***F21V 23/00*** | (2015.01) |
| ***F21K 9/272*** | (2016.01) |
| ***F21K 9/235*** | (2016.01) |
| *F21Y 115/10* | (2016.01) |

(52) U.S. Cl.

CPC ..... *F21K 9/232* (2016.08); *F21K 9/235* (2016.08); *F21K 9/272* (2016.08); *F21V 23/006* (2013.01); *F21Y 2115/10* (2016.08)

(58) Field of Classification Search

CPC .. F21K 9/235; F21K 9/272; F21K 9/23; F21S 8/043

See application file for complete search history.

(56) References Cited

U.S. PATENT DOCUMENTS

| | | | | |
|---|---|---|---|---|
| 4,104,713 | A * | 8/1978 | Chan | F21V 29/71 362/373 |
| 10,139,064 | B2 * | 11/2018 | Rizzo | F21V 3/061 |
| 2008/0170398 | A1 * | 7/2008 | Kim | H05B 45/50 315/210 |
| 2010/0277082 | A1 * | 11/2010 | Reed | F21V 29/773 315/159 |
| 2011/0002118 | A1 * | 1/2011 | Yip | F21V 5/046 165/185 |
| 2015/0138832 | A1 * | 5/2015 | Tickner | F21K 9/61 362/609 |
| 2015/0153037 | A1 * | 6/2015 | Lee | F21V 33/0056 381/334 |

(Continued)

*Primary Examiner* — Evan P Dzierzynski
(74) *Attorney, Agent, or Firm* — Chun-Ming Shih; Lanway IPR Services

(57) ABSTRACT

A lighting apparatus includes a fixing connector, a base holder, a light source and a light passing cover. The fixing connector includes an Edison socket and a fixing bracket. The base holder includes an Edison cap, a base wall and a base plate. The Edison cap is placed on a top side of the base plate. The base wall surrounds the Edison cap. The Edison cap is detachably inserted into the Edison socket of the fixing connector. The light source is disposed on a bottom side of the base plate. The top side and the bottom side of the base plate are opposite. The light passing cover is attached to the bottom side of the base plate for the light source to emit a light to pass through.

18 Claims, 10 Drawing Sheets

(56) References Cited

U.S. PATENT DOCUMENTS

| | | | | |
|---|---|---|---|---|
| 2016/0116146 | A1* | 4/2016 | Van Winkle | F21K 9/238<br>362/311.02 |
| 2018/0135819 | A1* | 5/2018 | Grandadam | F21S 9/02 |
| 2019/0191512 | A1* | 6/2019 | Zeng | F21S 8/026 |
| 2020/0248895 | A1* | 8/2020 | Tickner | F21V 29/78 |

* cited by examiner

LIGHTING APPARATUS

FIELD

The present invention is related to a lighting apparatus, and more particularly related to a lighting apparatus with flexibility to be installed in various places.

BACKGROUND

The time when the darkness is being lighten up by the light, human have noticed the need of lighting up this planet. Light has become one of the necessities we live with through the day and the night. During the darkness after sunset, there is no natural light, and human have been finding ways to light up the darkness with artificial light. From a torch, candles to the light we have nowadays, the use of light have been changed through decades and the development of lighting continues on.

Early human found the control of fire which is a turning point of the human history. Fire provides light to bright up the darkness that have allowed human activities to continue into the darker and colder hour of the hour after sunset. Fire gives human beings the first form of light and heat to cook food, make tools, have heat to live through cold winter and lighting to see in the dark.

Lighting is now not to be limited just for providing the light we need, but it is also for setting up the mood and atmosphere being created for an area. Proper lighting for an area needs a good combination of daylight conditions and artificial lights. There are many ways to improve lighting in a better cost and energy saving. LED lighting, a solid-state lamp that uses light-emitting diodes as the source of light, is a solution when it comes to energy-efficient lighting. LED lighting provides lower cost, energy saving and longer life span.

The major use of the light emitting diodes is for illumination. The light emitting diodes is recently used in light bulb, light strip or light tube for a longer lifetime and a lower energy consumption of the light. The light emitting diodes shows a new type of illumination which brings more convenience to our lives. Nowadays, light emitting diode light may be often seen in the market with various forms and affordable prices.

After the invention of LEDs, the neon indicator and incandescent lamps are gradually replaced. However, the cost of initial commercial LEDs was extremely high, making them rare to be applied for practical use. Also, LEDs only illuminated red light at early stage. The brightness of the light only could be used as indicator for it was too dark to illuminate an area. Unlike modern LEDs which are bound in transparent plastic cases, LEDs in early stage were packed in metal cases.

In 1878, Thomas Edison tried to make a usable light bulb after experimenting different materials. In November 1879, Edison filed a patent for an electric lamp with a carbon filament and keep testing to find the perfect filament for his light bulb. The highest melting point of any chemical element, tungsten, was known by Edison to be an excellent material for light bulb filaments, but the machinery needed to produce super-fine tungsten wire was not available in the late 19th century. Tungsten is still the primary material used in incandescent bulb filaments today.

Early candles were made in China in about 200 BC from whale fat and rice paper wick. They were made from other materials through time, like tallow, spermaceti, colza oil and beeswax until the discovery of paraffin wax which made production of candles cheap and affordable to everyone. Wick was also improved over time that made from paper, cotton, hemp and flax with different times and ways of burning. Although not a major light source now, candles are still here as decorative items and a light source in emergency situations. They are used for celebrations such as birthdays, religious rituals, for making atmosphere and as a decor.

Illumination has been improved throughout the times. Even now, the lighting device we used today are still being improved. From the illumination of the sun to the time when human can control fire for providing illumination which changed human history, we have been improving the lighting source for a better efficiency and sense. From the invention of candle, gas lamp, electric carbon arc lamp, kerosene lamp, light bulb, fluorescent lamp to LED lamp, the improvement of illumination shows the necessity of light in human lives.

There are various types of lighting apparatuses. When cost and light efficiency of LED have shown great effect compared with traditional lighting devices, people look for even better light output. It is important to recognize factors that can bring more satisfaction and light quality and flexibility.

There are various platforms for installing a light device. For example, there are UL boxes, J-Boxes or traditional Edison sockets in different places and different countries.

It would be beneficial to design a light device compatible with different installation platforms while keeping low cost and easy assembling.

SUMMARY

In some embodiments, a lighting apparatus includes a fixing connector, a base holder, a light source and a light passing cover.

The fixing connector includes an Edison socket and a fixing bracket.

The base holder includes an Edison cap, a base wall and a base plate.

The Edison cap is placed on a top side of the base plate.

The base wall surrounds the Edison cap.

The Edison cap is detachably inserted into the Edison socket of the fixing connector.

The light source is disposed on a bottom side of the base plate.

The top side and the bottom side of the base plate are opposite.

The light passing cover is attached to the bottom side of the base plate for the light source to emit a light to pass through.

In some embodiments, a first height of the base wall is larger than a second height of the Edison cap to conceal the Edison cap from a lateral view.

In some embodiments, the fixing bracket is a bar attached to a junction box installed on a ceiling.

In some embodiments, in a first mode, the Edison cap is installed to the Edison socket of the fixing connector for routing electricity from an external power source to the light source.

In a second mode, the Edison cap is detached from the Edison socket of the fixing connector and attached to another Edison socket.

In some embodiments, in a third mode, the base wall is attached with a pair of elastic units for fixing the base holder to a downlight platform.

In some embodiments, the pair of elastic units are torsion springs on two opposite sides of the base wall.

In some embodiments, the base plate is a circular disk, and the base wall are extended upwardly from a peripheral edge of the base plate.

In some embodiments, the light source is a LED module fixed directly on the bottom side of the base plate.

In some embodiments, the light source includes a LED module and a heat sink plate.

The LED module is attached on the heat sink plate and the heat sink plate is mounted on the bottom side of the base plate.

In some embodiments, the light passing cover has a circular cover and a circular wall.

A top edge of the circular wall is fixed to the bottom side of the base plate.

In some embodiments, the base holder has a bottom wall extended form the base plate.

The bottom wall surrounds the light source.

The light passing cover is fixed to an edge of the bottom wall.

In some embodiments, an inner surface of the bottom wall has a reflective layer for guiding the light of the light source to the light passing cover.

In some embodiments, a manual switch is placed on the top side of the base plate for selecting a setting of the light source.

In some embodiments, the light source has multiple types of LED modules with different optical parameters.

The setting is corresponding to a mixed parameter by mixing output lights of the multiple types of LED modules.

In some embodiments, a rotation switch is placed on the top side of the base plate for setting a light intensity of the light source.

In some embodiments, the Edison cap is detachable from the base holder.

In some embodiments, the Edison cap has a first electrode to be plugged to connect to a second electrode on the base plate.

In some embodiments, a driver is placed on the top side of the base plate.

The driver is surrounded by the base wall.

In some embodiments, an extended wire has a first head detachably connecting to the Edison cap of the base holder and a second head detachably connected to the Edison socket of the fixing connector.

In some embodiments, the extended wire is deformed to change a titl angle of the base holder with respect to the fixing connector.

DETAILED DESCRIPTION

Figure 11:
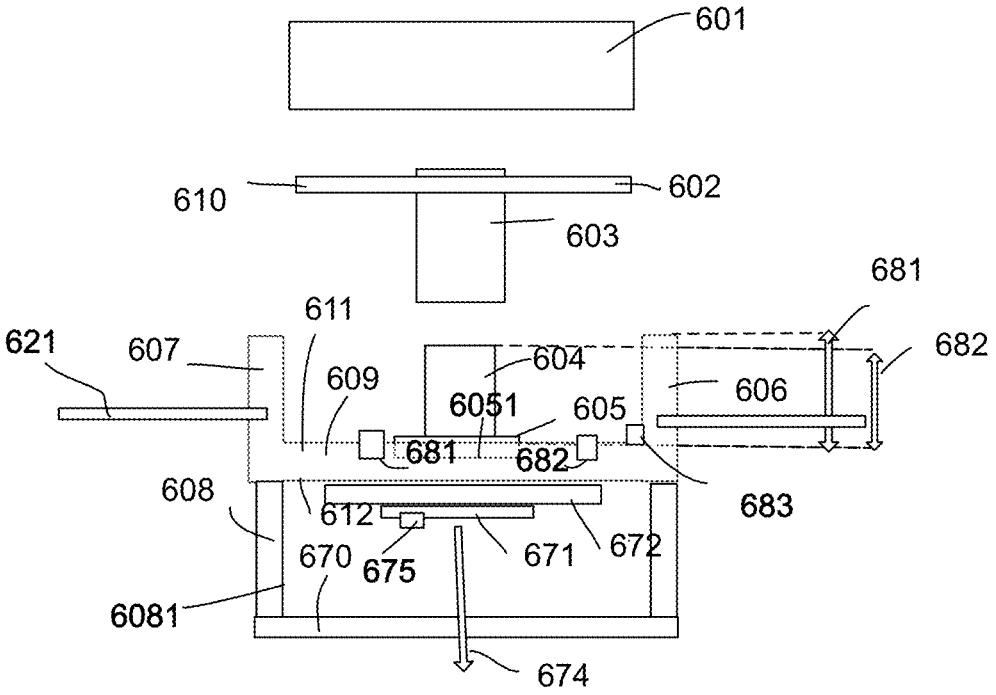
FIG. 11 illustrates an embodiment of a lighting apparatus.

Please refer to FIG. 11, which shows an embodiment. The lighting apparatus includes a fixing connector 610, a base holder 606, a light source 671 and a light passing cover 670.

The fixing connector 610 includes an Edison socket 603 and a fixing bracket 602. The Edison socket 603 may be any of various standards of Edison sockets widely used in the market. The bracket may be a housing integrated or assembled to be connected to the Edison socket. A wiring hole may be provided on the bracket for connecting a power wire. Screws, buckles or clips may be added on the bracket to be attach to a platform 601, e.g. a Junction Box, a UL Box or other platform to install the lighting apparatus.

The base holder 606 includes an Edison cap 604, a base wall 607 and a base plate 609.

The Edison cap 604 is placed on a top side 611 of the base plate 609.

The base wall 607 surrounds the Edison cap 604.

The Edison cap 604 is detachably inserted into the Edison socket 603 of the fixing connector 610.

The light source 671 is disposed on a bottom side 612 of the base plate 609.

The top side 611 and the bottom side 612 of the base plate are opposite.

The light passing cover 670 is attached to the bottom side 612 of the base plate 609 for the light source 671 to emit a light 674 to pass through.

In some embodiments, a first height 681 of the base wall 607 is larger than a second height 682 of the Edison cap 604 to conceal the Edison cap 604 from a lateral view. In other words, if you see the lighting apparatus from a side view, the base wall 607 covers the Edison cap 604. Such design makes the Edison cap to be concealed visually and also prevents dust to enter the area of Edison cap 604.

In some other embodiments, the Edison cap has a larger height than the base wall so that the Edison cap has a portion protruding above the top edge of the base wall.

Figure 12:
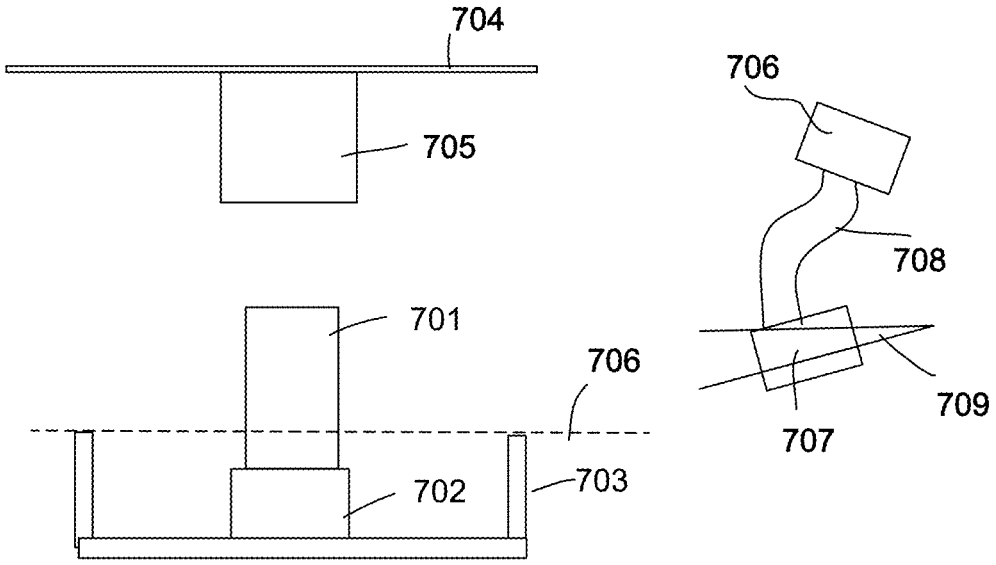
FIG. 12 illustrates another embodiment of a lighting apparatus.

Please see FIG. 12. In FIG. 12, the Edison cap 701 is protruding from a top edge 706 of the base wall 703 to be inserted into another Edison socket 705 installed on a ceiling 704.

In this embodiment, the Edison cap 701 is detached from the fixing connector mentioned above and attached to said another Edison socket 705. There is a protruding connector 702 for increasing the height of the Edison cap 701 with respect to the base wall 703. In other embodiments, the base wall or the Edison cap may be adjusted to have the setting as illustrated in FIG. 12.

In other words, the design provides at least two modes of installing the lighting apparatus. Specifically, in a first mode, the Edison cap is attached to the fixing connector which is further fixed to a platform, e.g. a Junction Box or an UL Box. In a second mode, the Edison cap is attached to another Edison socket directly.

In FIG. 11, the fixing bracket 602 is a bar attached to a platform 601, like junction box installed on a ceiling.

In some embodiments, in a first mode, the Edison cap is installed to the Edison socket of the fixing connector for routing electricity from an external power source to the light source.

In a second mode, the Edison cap is detached from the Edison socket of the fixing connector and attached to another Edison socket.

In some embodiments, in a third mode, the base wall is attached with a pair of elastic units for fixing the base holder to a downlight platform.

In some embodiments, the pair of elastic units 621 are torsion springs on two opposite sides of the base wall 607.

In some embodiments, the base plate is a circular disk, and the base wall are extended upwardly from a peripheral edge of the base plate. FIG. 1 to FIG. 10 show an example of such setting.

In some embodiments, the light source is a LED module fixed directly on the bottom side of the base plate.

In some embodiments, e.g. in FIG. 11, the light source 671 includes a LED module 675 and a heat sink plate 672.

The LED module is attached on the heat sink plate and the heat sink plate is mounted on the bottom side of the base plate.

Figure 2:
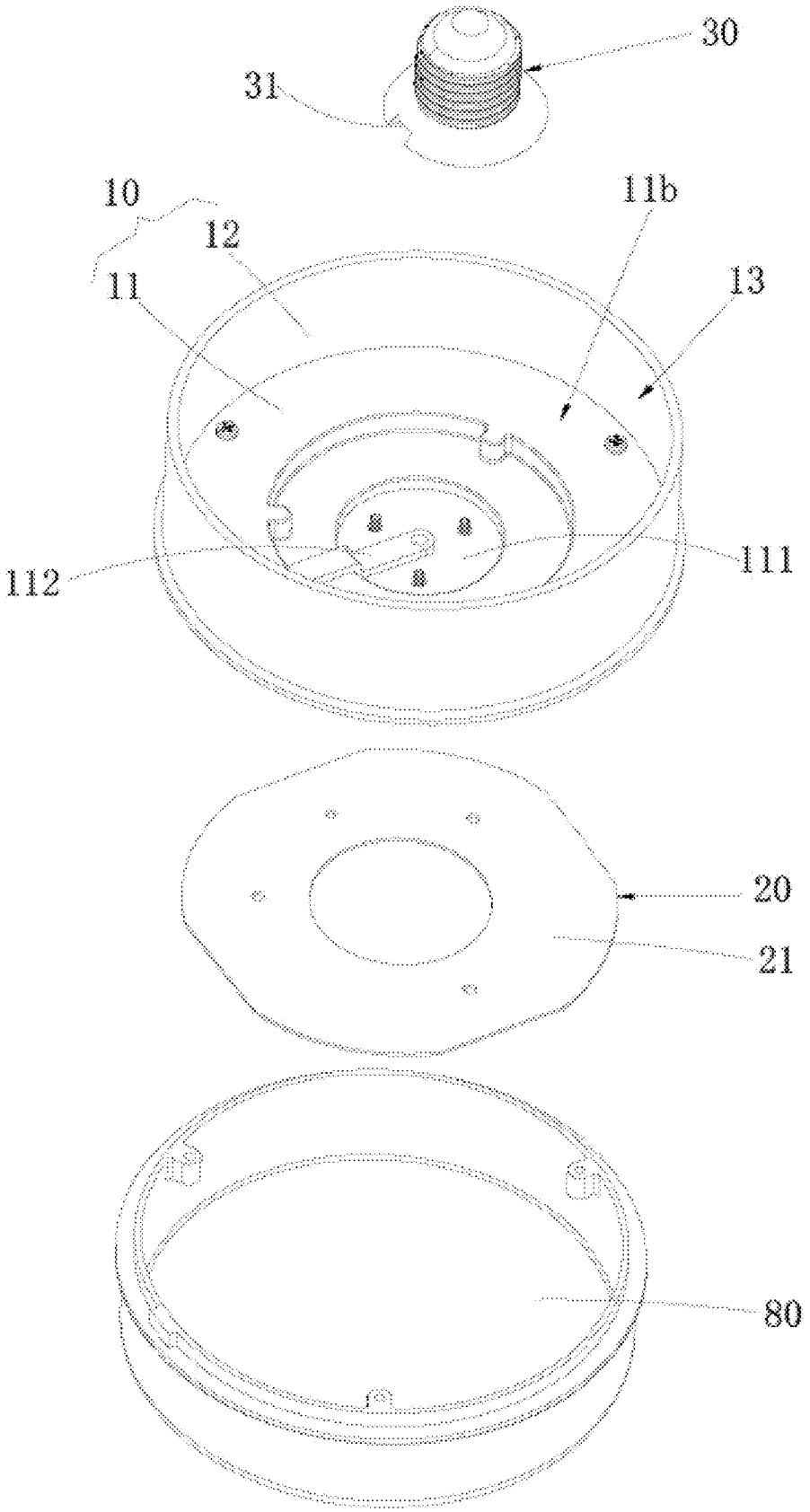
FIG. 2 illustrates an exploded view of the lighting apparatus embodiment.

In some embodiments, the light passing cover has a circular cover and a circular wall. FIG. 2 shows an example of such light passing cover 80 which has a lateral wall and a circular cover.

A top edge of the circular wall is fixed to the bottom side of the base plate.

In some embodiments, as shown in FIG. 11, the base holder has a bottom wall 608 extended form the base plate 609.

The bottom wall 608 surrounds the light source 671.

The light passing cover 675 is fixed to an edge of the bottom wall 608.

In some embodiments, an inner surface of the bottom wall has a reflective layer 6081 for guiding the light of the light source to the light passing cover 675.

In some embodiments, a manual switch 681 is placed on the top side 611 of the base plate 609 for selecting a setting of the light source 671.

In some embodiments, the light source 671 has multiple types of LED modules 675 with different optical parameters, e.g. having multiple types of LED modules with different color temperatures and/or colors to mix a required color temperature or a required color.

The setting is corresponding to a mixed parameter by mixing output lights of the multiple types of LED modules.

In some embodiments, a rotation switch 682 is placed on the top side of the base plate for setting a light intensity of the light source. The rotation switch 682 provides an additional setting candidate. For example, the manual switch 681 is used for selecting a color temperature, and the rotation switch 682 is used for setting a light intensity of the lighting apparatus. Some users may determine not to use the maximum light intensity when installing the lighting apparatus for saving power or have an overall consideration of the illuminance requirement. Two switch design helps a lot on achieving such goal.

In some embodiments, the Edison cap is detachable from the base holder.

In FIG. 11, the Edison cap has a first electrode 605 to be plugged to connect to a second electrode 6051 on the base plate 609.

In some embodiments, a driver 683 is placed on the top side of the base plate 609.

The driver is surrounded by the base wall 607 so as to be protected by the base wall 607.

In FIG. 12, an extended wire 708 has a first head 707 detachably connecting to the Edison cap 701 of the base holder and a second head 706 detachably connected to the Edison socket 705 of the fixing connector.

In some embodiments, the extended wire is deformed to change a titl angle 709 of the base holder with respect to the fixing connector.

Figure 1:
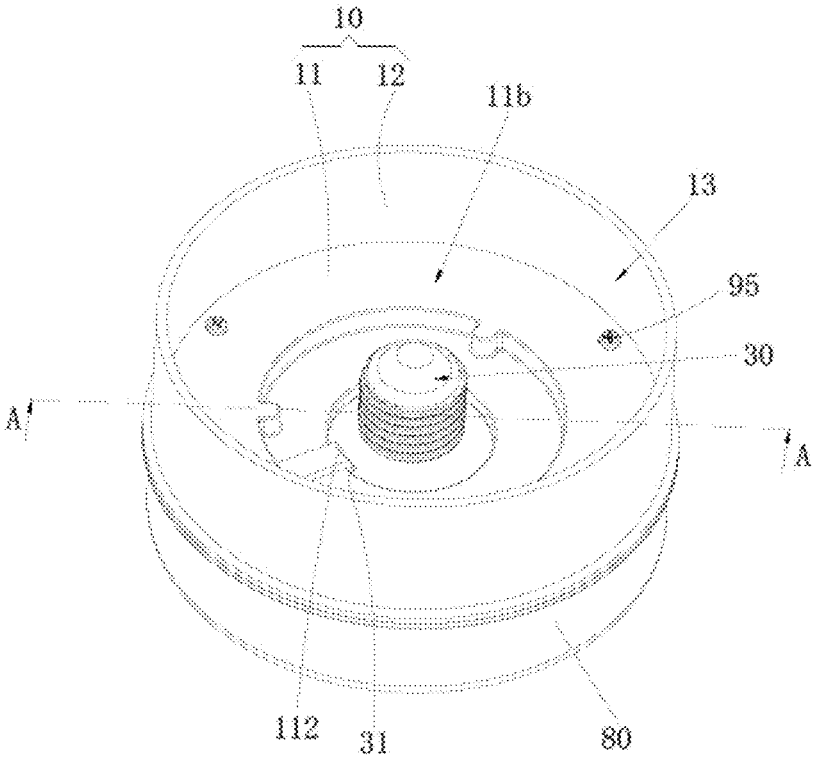
FIG. 1 illustrates a lighting apparatus example.

Please refer to FIG. 1. In FIG. 1, a lighting apparatus embodiment has a base holder 10 that has a base wall 12 and a base plate 11. An Edison cap 30 is placed on the top side 11*b* of the base plate 11. The base wall 12 and the base plate 11 defines a containing space 13 for storing the Edison cap 30. As mentioned above, a driver or other components may be placed in the containing space 13 in some embodiments.

There is a positioning groove 31 corresponding to a positioning bar 112 to ensure the assembly of the Edison cap 30 to be correctly installed to the base plate 11. There is a light passing cover 80 fixed on a bottom side of the base plate 11. There is a fixing unit like a screw 95 to fix the components together.

Please refer to FIG. 2, which shows an exploded view of the example in FIG. 1. The same reference numerals among drawings refer to the same components and may not be explained again for brevity.

In FIG. 2, the Edison cap 30 has a positioning groove 31 to be corresponding to the positioning groove 112 on the base plate 11 of the base holder 10. There is an installation groove 111 for installing the Edison cap 30.

A light source 20 has a substrate 21, which may have a metal layer as a heat sink. As mentioned above, LED modules may be mounted on the substrate 21.

The light passing cover 80 in this example has a circular cover and a surrounding wall both capable of passing light of the light source 20.

Figure 3:
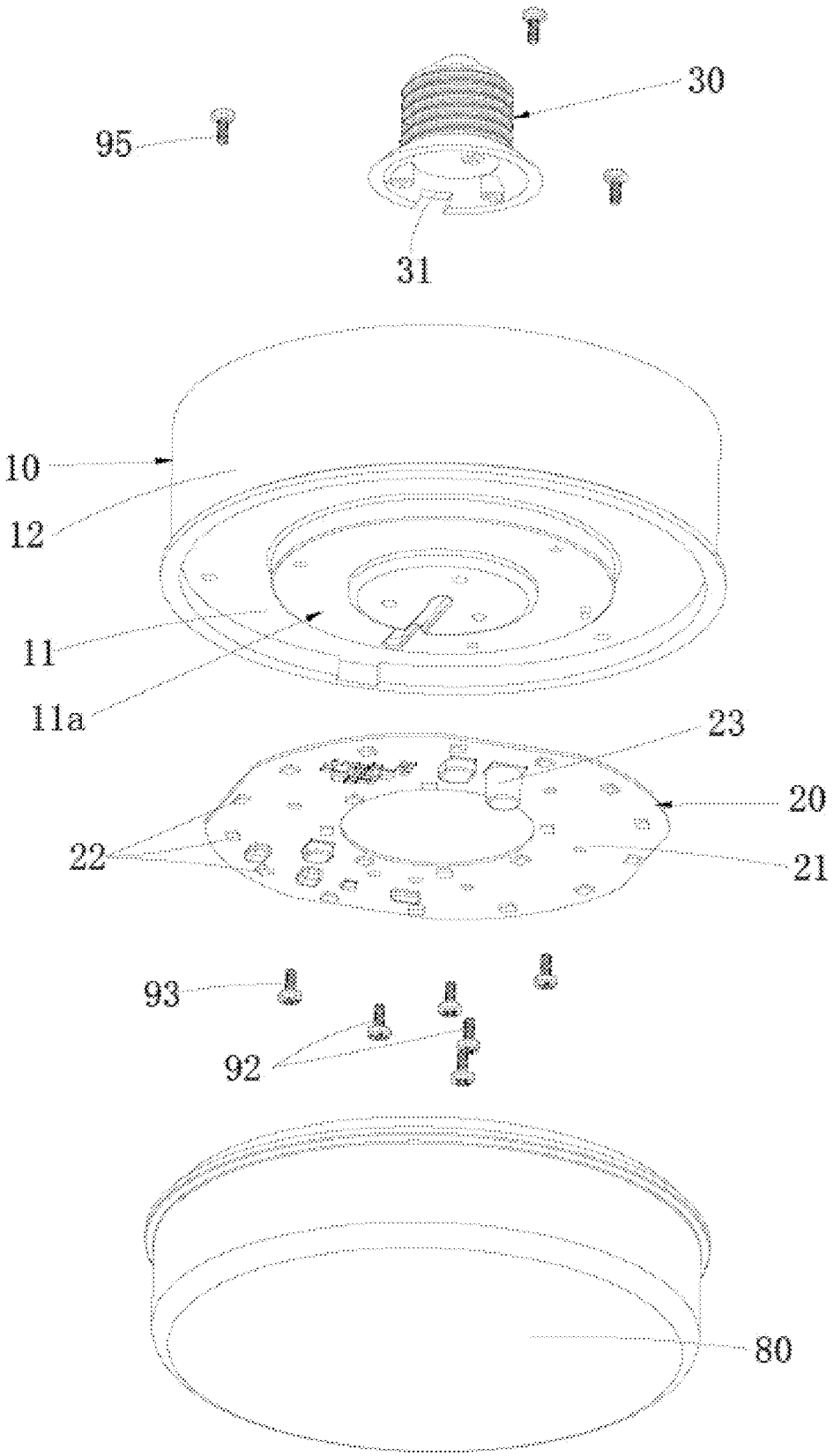
FIG. 3 illustrates another view of the example in FIG. 2.

FIG. 3 illustrates an exploded view of the example in FIG. 1 in another view.

In FIG. 3, there are screws 95 for fixing the Edison cap 30 to the base holder 10. The light source 20 has a driver 23 and LED modules 22. The driver 23 converts an external power source like 110V AC power to a driving current supplied to the LED modules 22. The substrate 21 may have a metal layer for heat dissipation. There are screws 93, 92 for fixing the substrate 21 to the bottom side 11*a* of the base plate 11.

Figure 4:
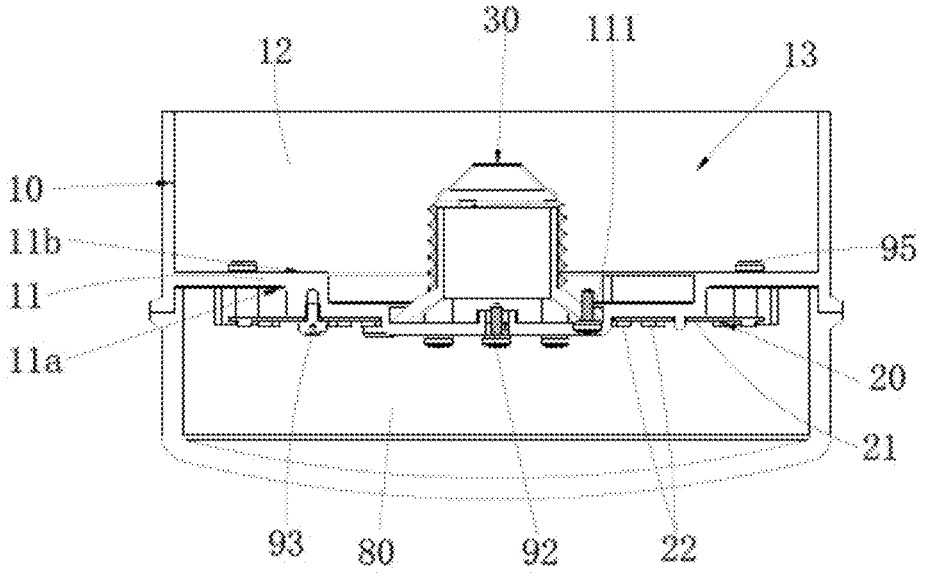
FIG. 4 illustrates a side view of the example in FIG. 1.

FIG. 4 shows a cross-sectional view of the example in FIG. 1. The components mentioned above may be more clearly understood with the help of FIG. 4.

Figure 5:
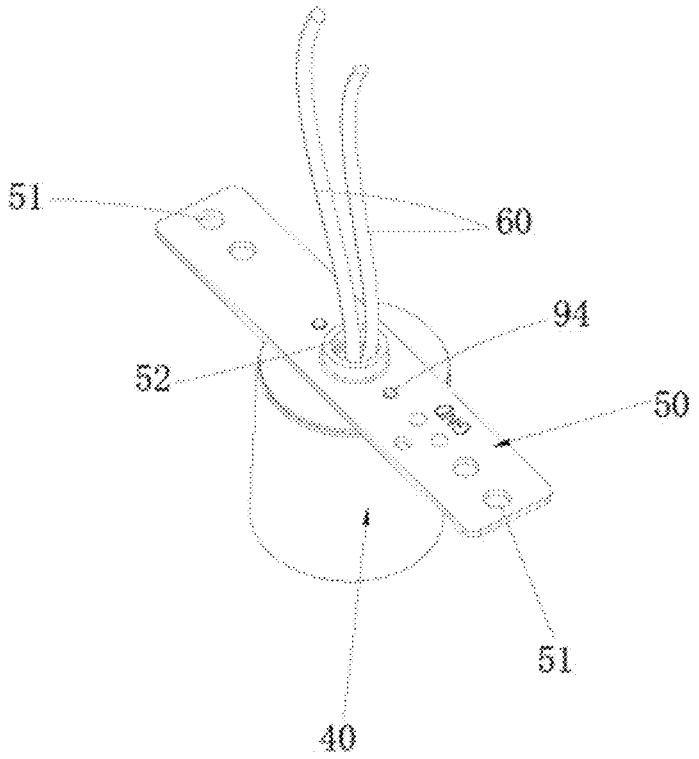
FIG. 5 illustrates an example of a fixing connector.

FIG. 5 shows a fixing connector example. The fixing connector has an Edison socket 40 for connecting to the Edison cap mentioned above. There is a fixing bracket 50 with through holes 51 for connecting to a platform like a Junction Box. There is a screw 94 for fixing the fixing bracket 50 to the Edison socket 40. A power wire is connected to the Edison socket 40 via the through hole 52.

Figure 6:
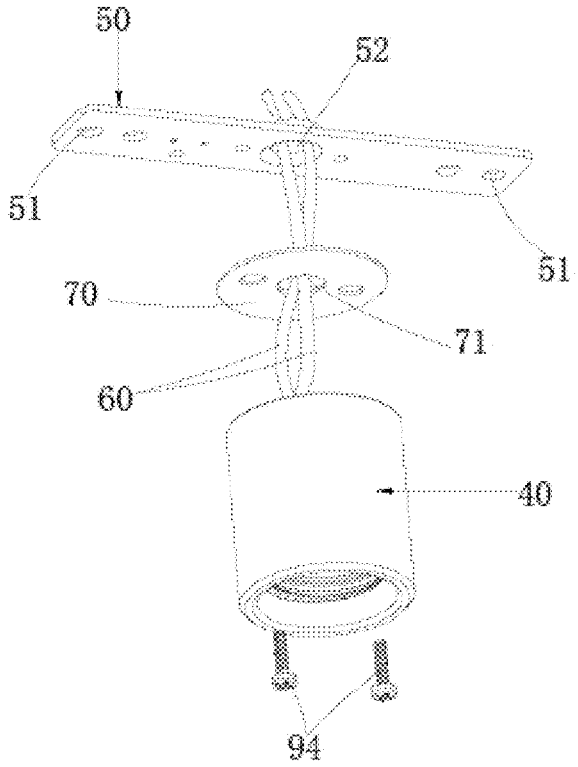
FIG. 6 illustrates an exploded view of the example of FIG. 5.

FIG. 6 shows another view of the example in FIG. 5. There is a pad plate 70 with a through hole 72 disposed between the fixing bracket 50 and the Edison socket 40. There are screws 94 for fixing the components together.

Figure 7:
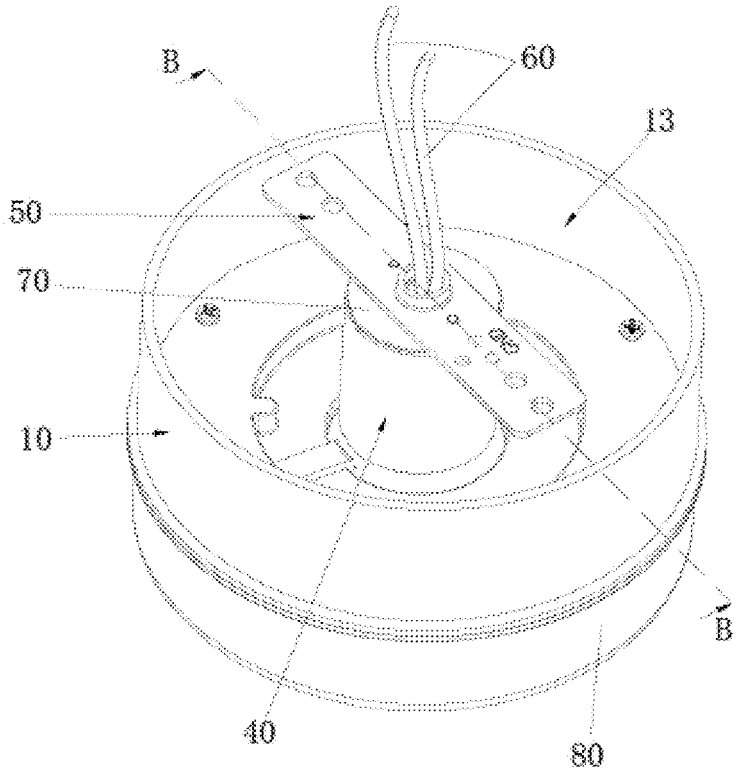
FIG. 7 illustrates a top view of the example in FIG. 1.

FIG. 7 shows an installation example by connecting the fixing connector to the base holder example mentioned above.

Figure 8:
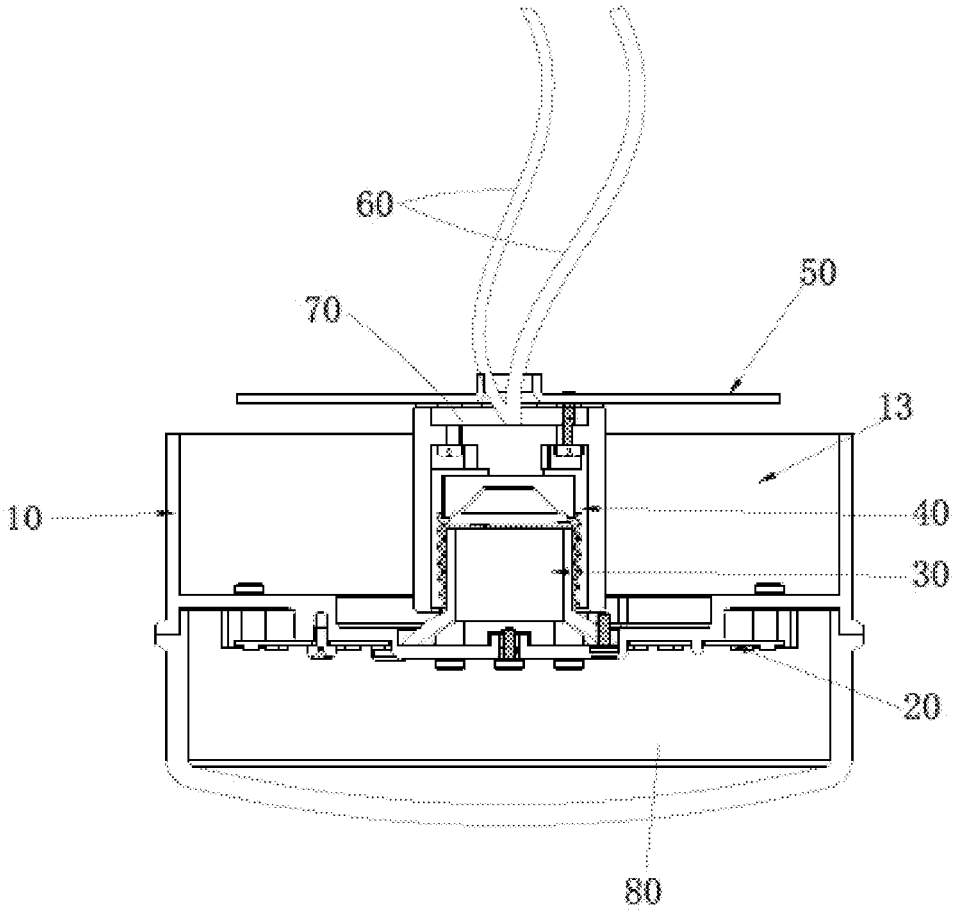
FIG. 8 illustrates a side view of an example.

FIG. 8 shows a side view of the example in FIG. 7.

Figure 9:
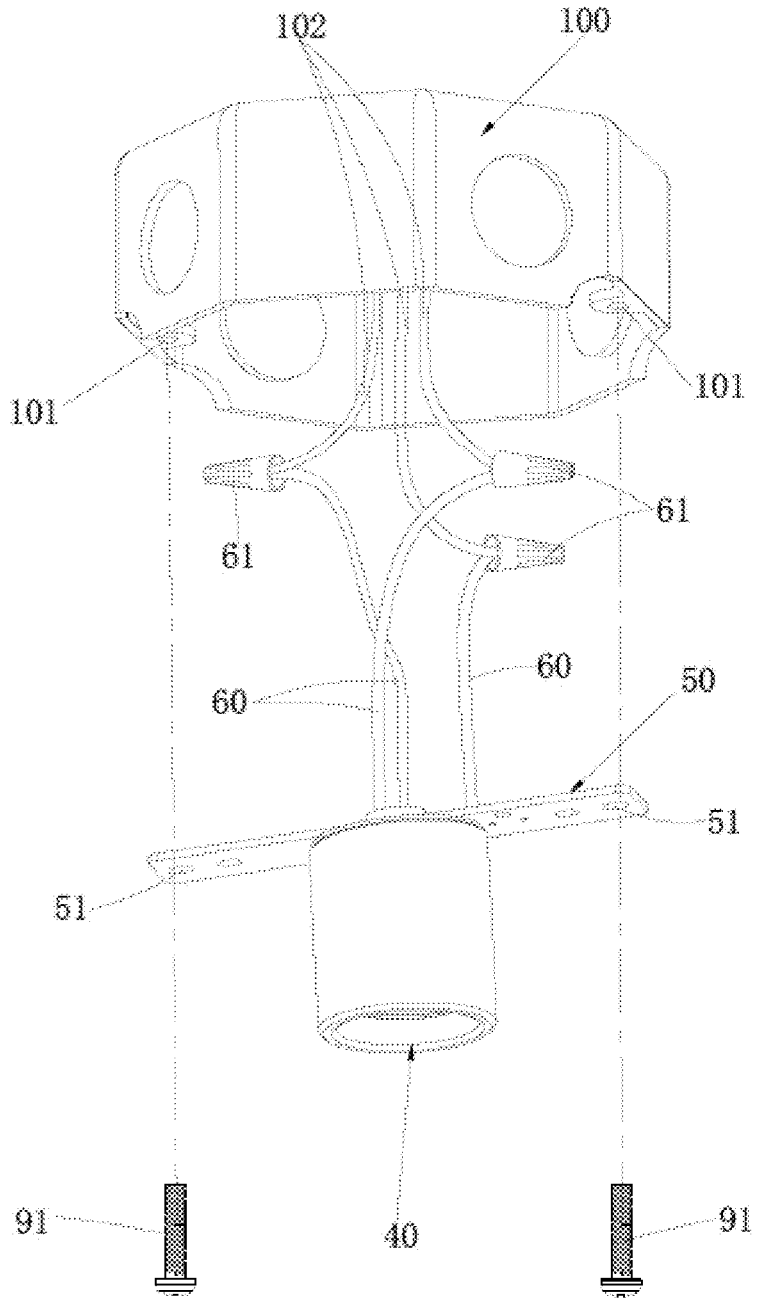
FIG. 9 illustrates an installation example.

FIG. 9 shows a Junction Box connection example.

In FIG. 9, the Junction Box 100 has power wires 102 connected to the power wire 60 of the fixing connector mentioned above with connectors 61. The screw holes 101 of the Junction Box 100 are used for fixing to the fixing bracket 50 mentioned above with screws 91.

Figure 10:
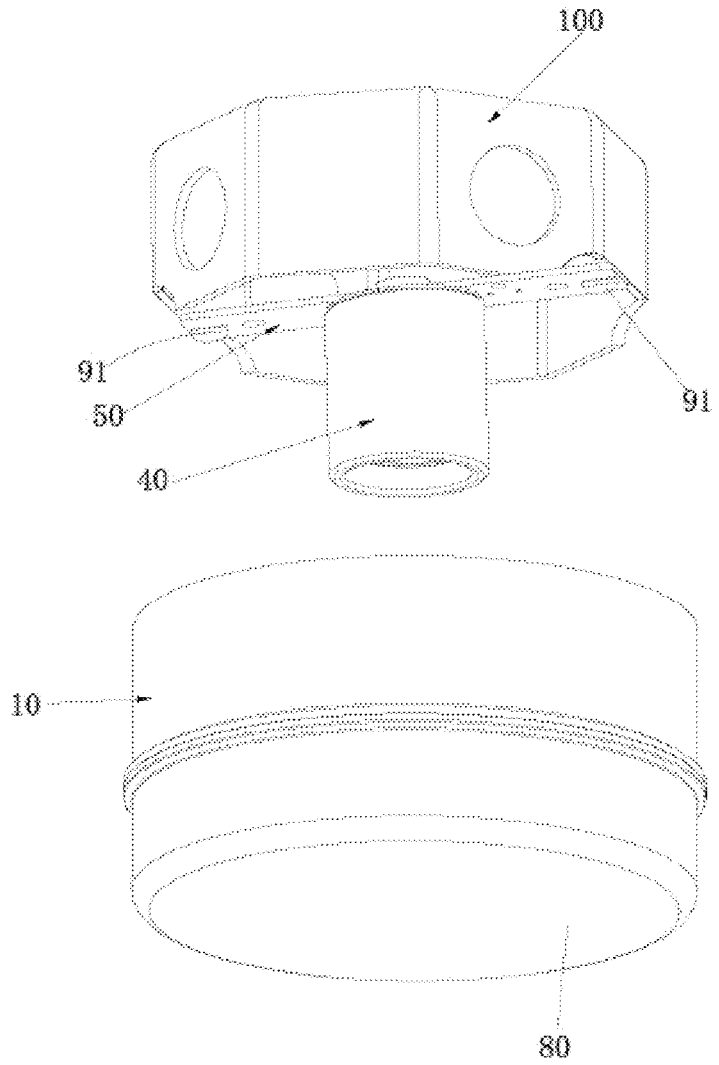
FIG. 10 illustrates another status of the example in FIG. 9.

FIG. 10 shows a following step after the fixing connector is fixed to the Junction box. The fixing connector is further attached to the base holder by connecting the Edison socket 40 to the Edison cap of the base holder 10.

The foregoing description, for purpose of explanation, has been described with reference to specific embodiments. However, the illustrative discussions above are not intended to be exhaustive or to limit the invention to the precise forms disclosed. Many modifications and variations are possible in view of the above teachings.

The embodiments were chosen and described in order to best explain the principles of the techniques and their practical applications. Others skilled in the art are thereby enabled to best utilize the techniques and various embodiments with various modifications as are suited to the particular use contemplated.

Although the disclosure and examples have been fully described with reference to the accompanying drawings, it is to be noted that various changes and modifications will become apparent to those skilled in the art. Such changes and modifications are to be understood as being included within the scope of the disclosure and examples as defined by the claims.

The invention claimed is:

1. A lighting apparatus, comprising:

a fixing connector comprising an Edison socket and a fixing bracket;

a base holder comprising an Edison cap, a base wall and a base plate, wherein the Edison cap is placed on a top side of the base plate, the base wall surrounds the Edison cap, wherein the Edison cap is detachably inserted into the Edison socket of the fixing connector;

a light source, wherein the light source is disposed on a bottom side of the base plate, the top side and the bottom side of the base plate are opposite; and a light passing cover attached to the bottom side of the base plate for the light source to emit a light to pass through, wherein the base plate is a circular disk, and the base wall are extended upwardly from a peripheral edge of the base plate, wherein the base holder has a bottom wall extended from the base plate, the bottom wall surrounds the light source, the light passing cover is fixed to an edge of the bottom wall.

2. The lighting apparatus of claim 1, wherein a first height of the base wall is larger than a second height of the Edison cap to conceal the Edison cap from a lateral view.

3. The lighting apparatus of claim 1, wherein the fixing bracket is a bar attached to a junction box installed on a ceiling.

4. The lighting apparatus of claim 1, wherein in a first mode, the Edison cap is installed to the Edison socket of the fixing connector for routing electricity from an external power source to the light source, wherein in a second mode, the Edison cap is detached from the Edison socket of the fixing connector and attached to another Edison socket.

5. The lighting apparatus of claim 4, wherein in a third mode, the base wall is attached with a pair of elastic units for fixing the base holder to a downlight platform.

6. The lighting apparatus of claim 5, wherein the pair of elastic units are torsion springs on two opposite sides of the base wall.

7. The lighting apparatus of claim 1, wherein the light source is a LED module fixed directly on the bottom side of the base plate.

8. The lighting apparatus of claim 1, wherein the light source comprises a LED module and a heat sink plate, the LED module is attached on the heat sink plate and the heat sink plate is mounted on the bottom side of the base plate.

9. The lighting apparatus of claim 1, wherein the light passing cover has a circular cover and a circular wall, a top edge of the circular wall is fixed to the bottom side of the base plate.

10. The lighting apparatus of claim 1, wherein an inner surface of the bottom wall has a reflective layer for guiding the light of the light source to the light passing cover.

11. The lighting apparatus of claim 1, wherein a manual switch is placed on the top side of the base plate for selecting a setting of the light source.

12. The lighting apparatus of claim 11, wherein the light source has multiple types of LED modules with different optical parameters, the setting is corresponding to a mixed parameter by mixing output lights of the multiple types of LED modules.

13. The lighting apparatus of claim 12, wherein a rotation switch is placed on the top side of the base plate for setting a light intensity of the light source.

14. The lighting apparatus of claim 1, wherein the Edison cap is detachable from the base holder.

15. The lighting apparatus of claim 14, wherein the Edison cap has a first electrode to be plugged to connect to a second electrode on the base plate.

16. The lighting apparatus of claim 1, wherein a driver is placed on the top side of the base plate, wherein the driver is surrounded by the base wall.

17. The lighting apparatus of claim 1, wherein an extended wire has a first head detachably connecting to the Edison cap of the base holder and a second head detachably connected to the Edison socket of the fixing connector.

18. The lighting apparatus of claim 17, wherein the extended wire is deformed to change a tilt angle of the base holder with respect to the fixing connector.

* * * * *